US008754342B2

(12) United States Patent
Heiskanen

(10) Patent No.: US 8,754,342 B2
(45) Date of Patent: Jun. 17, 2014

(54) TOP PUSH SWITCH

(75) Inventor: Juuso Heiskanen, Kaarina (FI)

(73) Assignee: Nokia Corporation, Espoo (FI)

( * ) Notice: Subject to any disclaimer, the term of this patent is extended or adjusted under 35 U.S.C. 154(b) by 168 days.

(21) Appl. No.: 13/300,173

(22) Filed: Nov. 18, 2011

(65) Prior Publication Data

US 2013/0126322 A1 May 23, 2013

(51) Int. Cl.
*H01H 1/10* (2006.01)

(52) U.S. Cl.
USPC ..... 200/513; 200/406

(58) Field of Classification Search
USPC ..... 200/513, 406
See application file for complete search history.

(56) References Cited

U.S. PATENT DOCUMENTS 6,011,224 A * 1/2000 Zdanys, Jr. ..... 200/16 D
8,243,442 B2 * 8/2012 Hobson et al. ..... 361/679.56
2012/0186965 A1 * 7/2012 Zieder ..... 200/513

FOREIGN PATENT DOCUMENTS

FR 2950193 A1 * 3/2011

OTHER PUBLICATIONS

"http://www.fuzing.com/vli/001564531225/metal-dome/snap-dome/tactile-dome/dome-sheet_circle-series", Copyright 2003-2010, 3 pages.

* cited by examiner

*Primary Examiner* — Renee Luebke
*Assistant Examiner* — Ahmed Saeed
(74) *Attorney, Agent, or Firm* — Locke Lord LLP

(57) ABSTRACT

In accordance with an example embodiment of the present invention, an apparatus is provided, including a dome of a top push switch configured to contact, upon pushing, an inner pad of a base, fixing paste connecting the dome to an outer pad of the base; and a covering tape on top of the dome.

16 Claims, 4 Drawing Sheets

TOP PUSH SWITCH

TECHNICAL FIELD

The present application relates generally to mechanical input devices.

BACKGROUND

Mechanical input devices typically function as a switch. In a conventional type of top push switch, the top push switch comprises a housing. A contact between an inner pad of a base and an outer pad of the base is formed when the top push switch is pushed.

SUMMARY

Various aspects of examples of the invention are set out in the claims.

According to a first example aspect of the invention there is provided an apparatus, comprising:

a dome of a top push switch configured to contact, upon pushing, an inner pad of a base;

fixing paste connecting the dome to an outer pad of the base; and a covering tape on top of the dome.

Said apparatus may be, for example, a top push switch or an apparatus (or device) comprising at least one top push switch. The fixing paste may be solder paste or another applicable electrically conductive fixing paste. The dome may be a solderable dome.

In certain example embodiments, the fixing paste holds the dome in its place and provides an electrical coupling (or connection) between the dome and the base (or circuit board).

In certain example embodiments, the apparatus comprises a leak-tight structure formed by the dome, fixing paste, covering tape and the base. In certain example embodiments, the apparatus is water proof due to 360° fixing paste. Accordingly, a water proof apparatus may be provided when the fixing paste surrounds the apparatus or contact area 360°. In certain example embodiments, there is circular fixing paste 360° between the base outer contact and the dome outer part. Fixing paste can be added on dome outer part already in switch manufacturer's production.

The dome may be a self-contained unit with its own cover sheet (or covering tape). In certain example embodiments, the dome comprises a standard dome as dome center. The dome center may be of round shape. Alternatively, the dome center may be of another suitable shape, such as a rounded triangle or another shape depending on the embodiment.

In certain example embodiments, the dome comprises an outer part and a center area (dome center) connected by at least one connection bridge. The outer part may totally surround the dome center. In certain example embodiments, said at least one connection bridge comprises a form stamped towards the base. The number of connection bridges can vary depending on the embodiment. In certain example embodiments, the number of connection bridges is one. In other embodiments, there may be two, three, or more connection bridges connecting the dome center and the outer part. The outer part may be a ring. In other example embodiments, the outer part is of another shape. The shape of the outer part may follow the shape of the dome. Accordingly, if the dome center is a filled ellipse the dome outer part may also be an ellipse.

The dome outer part may form (on its lower edge) a two-dimensional shape with a perimeter, such as a circle. The apparatus comprises fixing paste between the dome outer part perimeter and the outer pad of the base (or circuit board). Fixing paste between the dome outer part and the outer pad of the base may reside on the whole length of the perimeter. Alternatively, fixing paste between the dome outer part and the outer pad of the base may reside only on a part or parts of the perimeter. In the latter case the dome outer part may comprise a discontinuous perimeter (the lower edge of the dome outer part is non-planar) and the fixing paste only resides in points in which the dome outer part protrudes towards the outer pad of the base.

In certain example embodiments, said fixing paste is circular fixing paste. In certain example embodiments, the dome comprises an outer ring connected by the circular fixing paste (solder paste in certain embodiments) to the outer pad of the base.

In certain example embodiments, there is provided a top push switch comprising one piece metal which includes a dome, at least one connection bridge and an outer ring. In other embodiments, the dome center, connection bridge(s), and/or dome outer part may be separate pieces connected together (or touching one another) so that an electrical signal can travel therethrough. The outer part is fixed (soldered in certain embodiments) on an outer pad, and the dome will close the circuit to an inner pad (or center pad) when it collapses. In certain example embodiments, the outer part (an outer ring/circle in certain embodiments) of the dome is stamped on dome center, this creating a signal path through the dome.

In certain example embodiments, the apparatus comprises a space for escape air (when the dome collapses) between the dome center area and the outer part.

In certain example embodiments, the apparatus comprises a crimping in the tape.

In certain example embodiments, the apparatus is a hand-held mobile communication device, such as a mobile phone.

According to a second example aspect of the invention there is provided an apparatus, comprising:

a dome center configured to contact, upon pushing, an inner pad of a base;

at least one connection bridge; and a dome outer part, the dome center being connected to the dome outer part by the at least one connection bridge, and the dome outer part being configured to be fixed to an outer pad of the base.

In certain example embodiments, the apparatus is a solderable dome. The solderable dome may be purchased from a dome manufacturer and may be attached to a circuit board by a device manufacturer.

In certain example embodiments, the dome outer part is configured to be fixed to the outer pad by soldering. In certain example embodiments, the outer part is a ring.

The features of the first example aspect and its embodiments other than listed herein are also applicable to the second example aspect and its embodiments.

According to a third example aspect of the invention there is provided a method, comprising:

adding fixing paste between a dome of a top push switch and an outer pad of a base;

connecting the dome to the outer pad of the base by the fixing paste; and covering the dome by a tape.

In certain example embodiments, the fixing paste is added on an outer part of the dome. In certain example embodiments, the fixing paste is added on the outer pad of the base. The outer part may be a ring. It may be flat shaped. In certain example embodiments, the dome is connected to the outer pad by fixing with the aid of the fixing paste (by soldering with the aid of solder paste in certain example embodiments).

In certain embodiments, the covering tape is fixed to the structure by adhesive or heat press.

In certain example embodiments, fixing paste is added on dome outer ring in switch manufacturer's production. The manufactured component (top push switch) may come in one part from the supplier (switch manufacturer) to the device manufacturer.

Different non-binding example aspects and embodiments of the present invention have been illustrated in the foregoing. The above embodiments are used merely to explain selected aspects or steps that may be utilized in implementations of the present invention. Some embodiments may be presented only with reference to certain example aspects of the invention. It should be appreciated that corresponding embodiments may apply to other example aspects as well. Any appropriate combinations of the embodiments may be formed.

BRIEF DESCRIPTION OF THE DRAWINGS

For a more complete understanding of example embodiments of the present invention, reference is now made to the following descriptions taken in connection with the accompanying drawings in which.

DETAILED DESCRIPTION

Example embodiments of the present invention and their potential advantages are understood by referring to FIGS. 1 through 8 of the drawings. In the following description, like numbers denote like elements. The terms solder paste and soldering have been used as examples of fixing paste and attaching with the aid of fixing paste, respectively. Also the term outer ring has been used as an example of the outer part of a dome. These and other exemplary terms used in the following description are to be considered as non-limiting examples.

Figure 1:
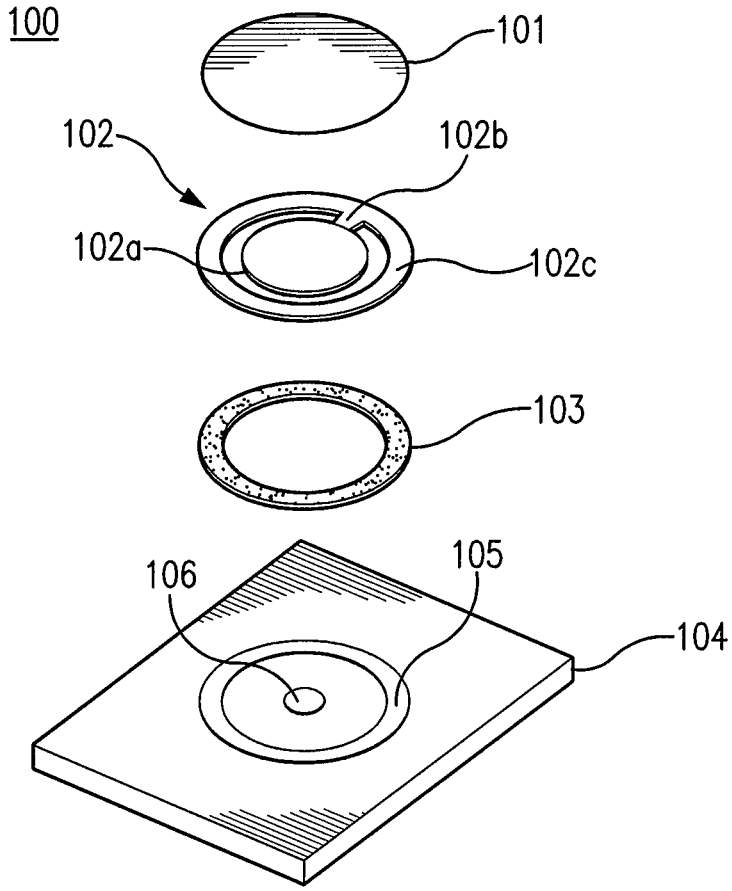
FIG. 1 shows an exploded view of an apparatus in accordance with an example embodiment of the invention.

FIG. 1 shows an exploded view of a top push switch in accordance with an example embodiment of the invention. The top push switch 100 comprises a dome 102, solder paste 103, and a covering tape 101. The dome 102 is placed on a base 104 comprising an outer contact 105 and an inner contact 106. The base 104 can be a circuit board (a printed circuit board (PCB) or printed wiring board (PWB)) of conventional design. The covering tape 101 can be added in by a switch manufacturer. It can be fixed to the structure, for example, by adhesive or heat press. The covering tape 101 can be, for example, polyimide tape.

The dome 102 comprises an outer ring 102*c* (although in other embodiments an outer part of different shape may be used) connected to dome center area 102*a* by a connection bridge 102*b*. The center area 102*a* (hereinafter referred to as dome center 102*a*) can be round shaped. Accordingly, it can be a round shaped dome known as such (although in other embodiments the dome center 102*a* may be of different shape depending on the embodiment). The dome center 102*a*, connection bridge 102*b* (although in other embodiments two or more connection bridges may be used) and outer ring 102*c* can all be of same metal. They can form one piece. It can be stamped from same metal strip. The connection bridge 102*b* and outer ring 102*c* can be flat shaped.

The outer ring 102*c* is soldered to the outer contact 105 of the circuit board 104. In an embodiment, the solder paste 103 used for soldering follows the shape of the outer pad 105 or the outer ring 102*c* or both. Accordingly, in the embodiment shown in FIG. 1 the solder paste 103 is ring-like or circular. When the solder paste 103 forms a closed continuous shape, the top push switch becomes leak-tight, that is, air and water proof if the covering tape also is air and water proof. In other words, the covering tape 101, the dome 102, the stiffened solder paste 103 and the circuit board 104 then form a closed volume or pocket in the interior of the switch, which is water and air proof. The contact area in the interior of the switch can be shielded in this way.

The outer ring 102*c* soldered on the outer pad holds the whole switch in place when soldered to the circuit board 104. The connection bridge 102*b* holds the dome center 102*a* in position and creates an electrical connection between dome center 102*a* and the outer ring 102*c*. The dome center 102*a* closes the electrical circuit to the inner pad upon the user pushing the dome 102.

The circuit board 104 contains electrically insulating material between the inner pad 106 and outer pad 105. The dome 102 and the solder paste 103 are electrically conductive. In an embodiment, when the user pushes the dome center 102*a* against the circuit board 104, the dome center 102*a* collapses. This gives the user a tactile response (a click feeling or similar). The dome center 102*a* touching the inner pad 106 closes the electric circuit between the inner pad 106 (for example "+" pad) and the outer pad 105 (for example "−" pad) resulting in the desired operation of the switch, the operation being known as such.

Figure 2:
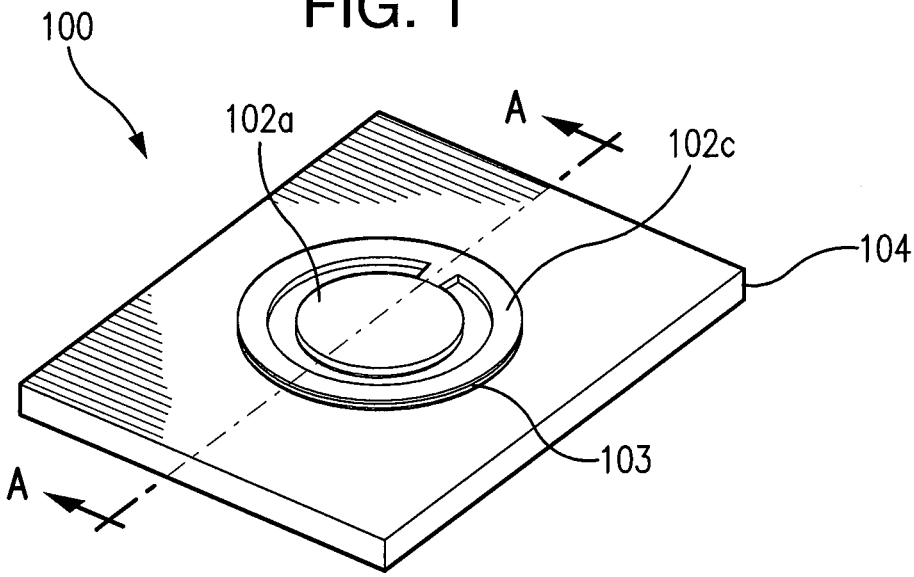
FIG. 2 shown the apparatus of FIG. 1 as assembled in accordance with an example embodiment.

FIG. 2 show the top push switch of FIG. 1 as assembled. The covering tape 101 covering the dome is not visible in FIG. 2.

Figure 3:
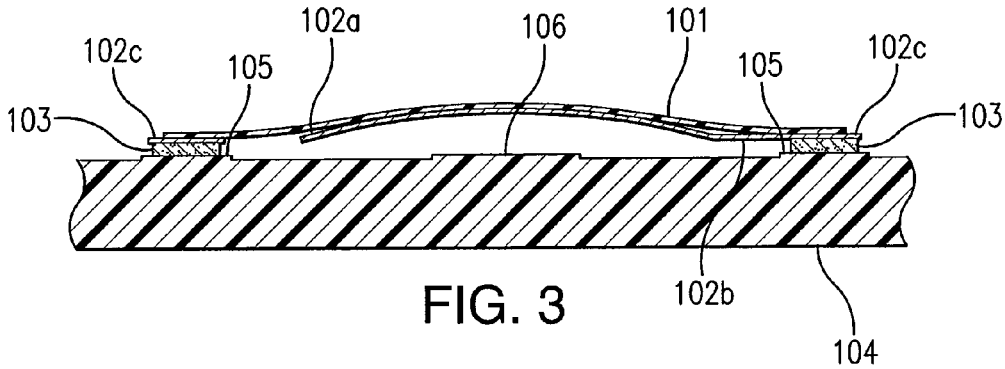
FIG. 3 shows a sectional view of the apparatus of FIG. 1 in accordance with an example embodiment.

FIG. 3 shows a sectional view of the top push switch of FIGS. 1 and 2 along section A-A drawn in FIG. 2. It becomes evident from FIG. 3 that when the user pushes the structure from the top the dome center 102*a* below the flexible covering tape 101 first touches at its outline the circuit board 104 between the contacts 105 and 106. The dome center 102*a* then collapses (i.e., deforms, not shown) due to the push so that it touches the inner pad 106 thus closing the electrical circuit between the pads 105 and 106 (via the stiffened solder paste 103 and dome 102).

Figure 4:
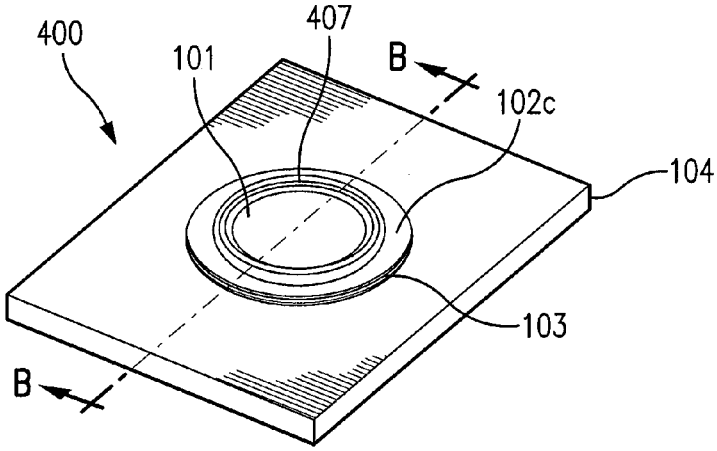
FIG. 4 shows an apparatus in accordance with another example embodiment of the invention.
Figure 5:
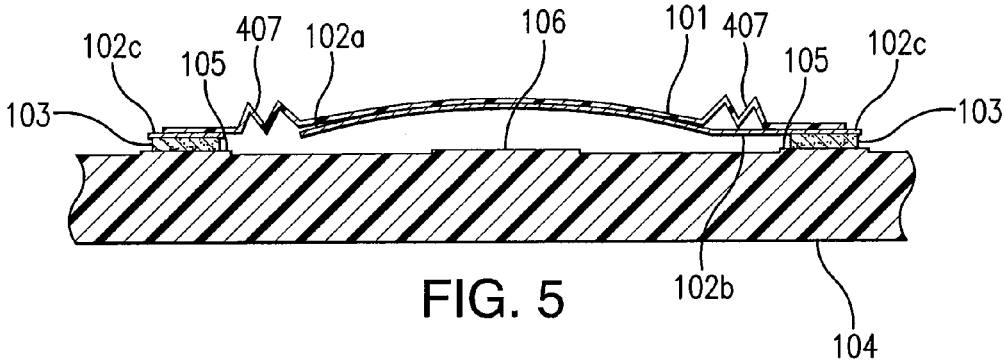
FIG. 5 shows a sectional view of the apparatus of FIG. 1 in accordance with an example embodiment.

In certain example embodiments, the top push switch comprises a space for escape air (when the dome collapses) between the dome center area and the outer ring. FIG. 4 shows a top push switch in accordance with an example embodiment. The embodiment shown in FIG. 4 otherwise corresponds to the embodiments shown in FIGS. 1-3 except that the flexible covering tape 101 in the embodiment shown in FIG. 4 has an optional crimping 407. This is shown more clearly in the sectional view of FIG. 5. The crimping 407 forms a place for air escaping from the center area of the switch 400 when the dome is pressed down (or collapses). When the switch 400 is leak-tight the air space can be increased for example in this way. Other arrangements to increase the air space are also possible.

Figure 6:
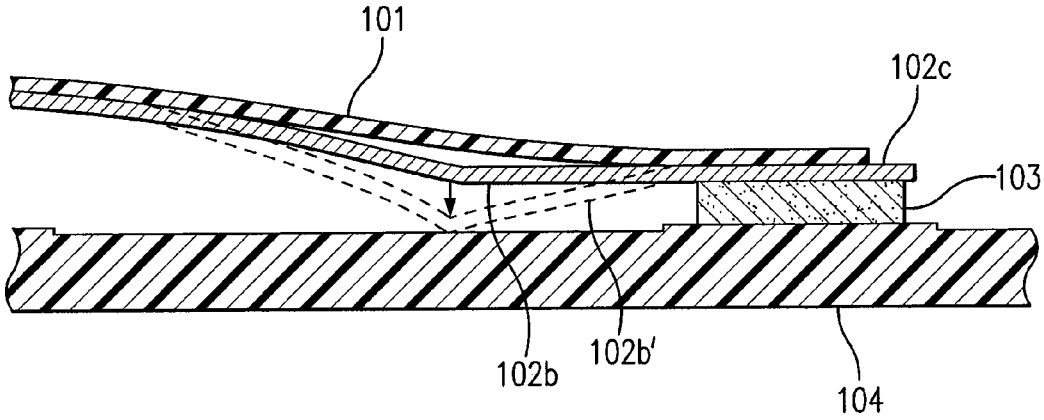
FIG. 6 shows yet another example embodiment.

FIG. 6 shows yet another example embodiment. This embodiment may otherwise correspond to the preceding embodiments except that the structure of the connection bridge 102*b* is different. The reference numeral 102*b* shows the structure of the connection bridge in other embodiments. Since the solder paste 103 will lift the dome a little bit from the circuit board surface, the connection bridge 102*b*', in this embodiment, is stamped downwards to compensate the lifting.

Figure 7:
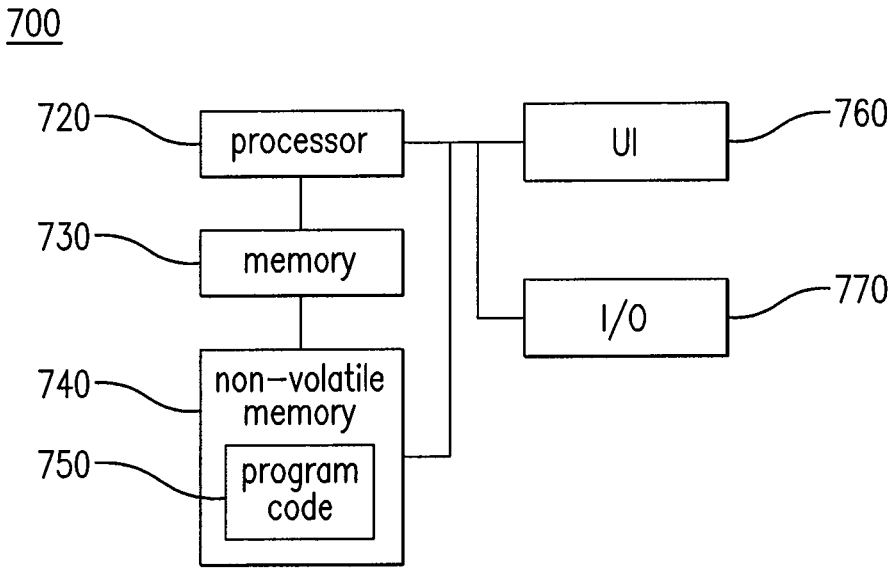
FIG. 7 shows a block diagram of an apparatus in accordance with an example embodiment of the invention.

FIG. 7 shows an example block diagram of an apparatus 700 comprising at least one top push switch according to an example embodiment. The apparatus 700 comprises at least one non-volatile memory 740 configured to store computer programs or software comprising computer program code 750. The apparatus 700 further comprises at least one processor 720 for controlling the operation of the apparatus 700 using the computer program code 750, a work memory 730 for running the computer program code 750 by the at least one processor 720, and optionally an input/output system 770 for communicating with other entities or apparatuses. Accordingly, the input/output system 770, if present, comprises one or more communication units or modules providing communication interfaces towards a communication network and/or towards another apparatus. The apparatus 700 comprises a user interface 760 enabling a user to use the device. The user interface 760 comprises at least one top push switch. The user may input information to the apparatus 700 via the at least one top push switch. Reading of user input received via the top push switch is controlled by the at least one processor 720.

Figure 8:
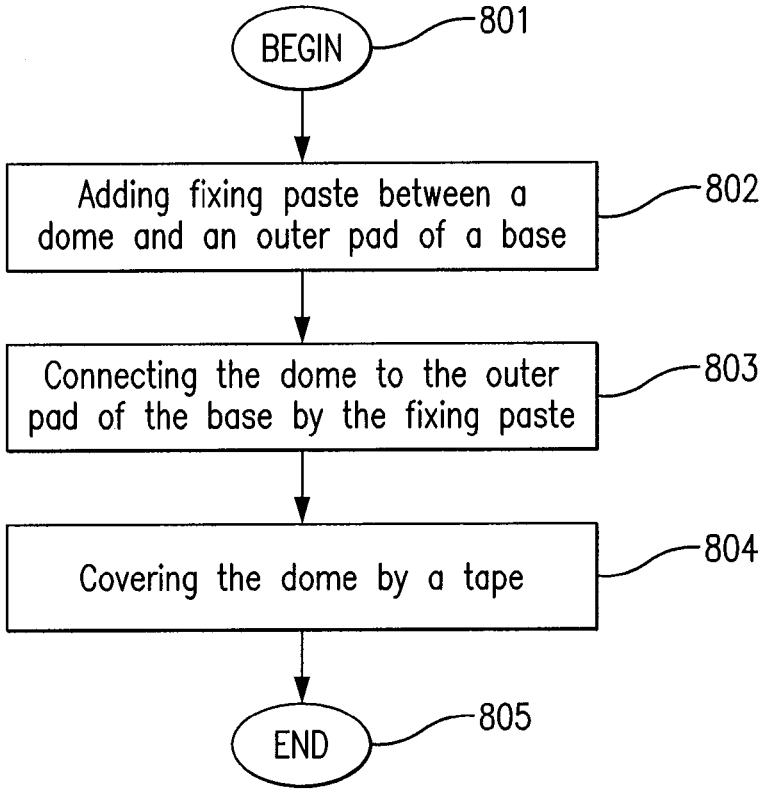
FIG. 8 shows a rough flow diagram showing a method in accordance with an example embodiment of the invention.

FIG. 8 is a flow diagram showing a method for manufacturing a top push switch in accordance with an example embodiment. The method begins at step 801. In step 802, fixing paste (e.g., solder paste) is added between a dome and an outer pad of a base. In practice, the fixing paste may be added for example on the outer ring of the dome. In step 803, the dome is connected to the outer pad of the base by fixing (e.g., soldering) with the aid of the fixing paste. In step 804, the resulting structure is covered by a covering tape. The method ends at step 805.

There may be a number of variations to the described embodiments. For example, the dome center may alternatively be a side cutted dome.

The component (top push switch) may come as a one part and covering tape can be added for example in supplier's autoassembly line.

Concerning the connection bridge stamping and referring again to FIG. 6, even if there remains a small gap between the lowest point of the connection bridge and the circuit board the end user is expected to feel a proper tactile response (a click feeling or similar) in response to the dome collapsing. The flat shaped connection bridge is flexible and, before the tactile response, it will just bend down a bit until an outer edge of the dome touches the circuit board surface.

The thickness of the top push switch may be, for example, around 0.3 mm (covering tape around 0.05 mm, dome around 0.2 mm, fixing paste around 0.05 mm).

In a variation to the shown example embodiments, the top push switch can further comprise a specific integrated actuator, such as a plunger pin know as such. In a variation to the shown example embodiments, the top push switch can further comprise dimples known as such.

Without in any way limiting the scope, interpretation, or application of the claims appearing below, certain technical effects of one or more of the example embodiments disclosed herein are listed in the following: A technical effect is a low cost top push switch. A technical effect is a more environmental friendly top push switch. The top push switch can be manufacture without an insert molding process. There is less waste material due to the absence of a housing. A technical effect is a thin structure. The top push switch without a housing, such as a conventional plastic housing, can be implemented. A technical effect is a manufacturing process with only one stamping process. A stamping process for signal legs is not needed. A technical effect is that in addition to dust proofness also water proofness can be achieved. A technical effect is less mechanical parts since a housing is not needed to accommodate the structure due to the circular solder/fixing paste or circular pasting.

The foregoing description has provided by way of non-limiting examples of particular implementations and embodiments of the invention a full and informative description of the best mode presently contemplated by the inventors for carrying out the invention. It is however clear to a person skilled in the art that the invention is not restricted to details of the embodiments presented above, but that it can be implemented in other embodiments using equivalent means or in different combinations of embodiments without deviating from the characteristics of the invention.

If desired, the different functions discussed herein may be performed in a different order and/or concurrently with each other. Furthermore, if desired, one or more of the above-described functions may be optional.

Furthermore, some of the features of the above-disclosed embodiments of this invention may be used to advantage without the corresponding use of other features. As such, the foregoing description shall be considered as merely illustrative of the principles of the present invention, and not in limitation thereof. Hence, the scope of the invention is only restricted by the appended patent claims.

The invention claimed is:

1. An apparatus, comprising:

a dome of a top push switch configured to contact, upon pushing, an inner pad of a base;

fixing paste electrically connecting the dome to an outer pad of the base; and a covering tape on top of the dome, wherein the dome comprises an outer loop connected by the paste to the outer pad of the base.

2. The apparatus of claim 1, comprising a leak-tight structure formed by the dome, fixing paste, covering tape and the base.

3. The apparatus of claim 1, wherein the dome comprises a dome outer part and a center area connected by at least one connection bridge.

4. The apparatus of claim 3, wherein said at least one connection bridge comprises a form stamped towards the base.

5. The apparatus of claim 3, wherein the outer part is a ring.

6. The apparatus of claim 1, wherein said fixing paste is solder paste.

7. The apparatus of claim 1, wherein the outer loop is an outer ring.

8. The apparatus of claim 1, wherein the apparatus comprises a crimping in the tape.

9. An apparatus according to claim 1, wherein the apparatus is a handheld mobile communication device.

10. An apparatus, comprising:

a dome center configured to contact, upon pushing, an inner pad of a base;

at least one connection bridge; and a dome outer part, the dome center being electrically connected to the dome outer part by the at least one connection bridge, and the dome outer part being a loop configured to be fixed and electrically connected to an outer pad of the base by fixing paste.

11. An apparatus according to claim 10, wherein the apparatus is a solderable dome, the dome outer part being configured to be fixed to the outer pad by soldering.

12. An apparatus according to claim 10, wherein the outer part is a ring.

13. A method, comprising:

adding fixing paste between a dome of a top push switch and an outer pad of a base, wherein the dome comprises an outer loop;

electrically connecting the dome by the outer loop to the outer pad of the base by the fixing paste; and covering the dome by a tape.

14. The method of claim 13, wherein the fixing paste is added on an outer part of the dome.

15. The method of claim 13, wherein the fixing paste is solder paste.

16. The method of claim 13, wherein the outer loop is an outer ring.

* * * * *